US005077921A

United States Patent [19]

Mooney

[11] Patent Number: 5,077,921

[45] Date of Patent: Jan. 7, 1992

[54] PHOTO DISPLAY APPARATUS

[76] Inventor: Peter T. Mooney, 415 School Rd., #72, Indian Harbour Beach, Fla. 32937

[21] Appl. No.: 617,668

[22] Filed: Nov. 26, 1990

[51] Int. Cl.[5] ..... A47G 1/06; G09F 1/12

[52] U.S. Cl. ..... 40/152.1; 40/158.1; 248/470

[58] Field of Search ..... 40/152.1, 591, 593, 40/600, 156, 158.1, 159, 611, 649; 248/467, 469, 470

[56] References Cited

U.S. PATENT DOCUMENTS

| | | | |
|---|---|---|---|
| 3,335,514 | 8/1967 | Blackman | 40/158.1 |
| 3,745,680 | 7/1973 | Faust | 40/156 |
| 4,041,630 | 8/1977 | Holbrook | 40/649 X |
| 4,300,692 | 11/1981 | Moreno | 248/467 X |
| 4,605,292 | 8/1986 | McIntosh | 248/467 X |
| 4,776,117 | 10/1988 | Astolfi | 40/152.1 |

*Primary Examiner*—Kenneth J. Dorner
*Assistant Examiner*—J. Bonifanti
*Attorney, Agent, or Firm*—William M. Hobby, III

[57] ABSTRACT

A photo display apparatus has a frame having four side members and having an opening slot through one side member for the sliding of matted photographs or display items therethrough. A photo mat board has two sides and a plurality of windows cut out therein for mounting photographs or display items and a transparent polymer covering is fixedly attached to one side of the mat and is removably adhered to the other side of the mat. The mat is covered on one side with an adhesive material, such as a micro-encapsulated adhesive material for supporting display items over the cut out windows in the mat board for display and the polymer covering is removably adhered thereover and held to the mat with the same adhesive holding the display items. One or more display support members can be removably attached to the display frame for holding the display apparatus on a horizontal surface or alternatively attached to a flat ferric metal surface in a second position using magnetic strips attached to the display support member. Each display support member has a long arm and a short arm attached together at an angle to each other with the long arm having a magnetic strip thereon along with a spring clip for attaching a piece of mat board thereto.

6 Claims, 1 Drawing Sheet

PHOTO DISPLAY APPARATUS

SUMMARY OF THE INVENTION

The present application relates to a photo display apparatus and especially to a photo display apparatus which can be magnetically attached to a refrigerator or other metal surface and alternatively supported on a flat horizontal surface like a picture frame.

In the past it has been common to supply a great variety of photo and display frames and devices for displaying frames by attaching the frames to a wall or with mounting legs for displaying on a desk or a horizontal surface. It has also been common to provide display surfaces which are magnetically attached to a refrigerator or other ferric metal surface which can be easily removed and replaced. Display items which can be attached to refrigerators or other metal surfaces can be seen in the U.S. Pat. No. to Selman, 4,852,282, for a magnetic calendar frame which has a magnetic attachment for the upper freezer door of a refrigerator freezer and in the Longo et al. patent No. 3,187,449, for a magnetic picture frame and sign which can be detachably secured to a metal dashboard or any para-magnetic surface in an automobile to display vehicle and driver information. Similarly, in the Griggs patent No. 3,237,327, an automobile certificate holder is provided for holding the vehicle registration or certificate and which can be easily attached to the vehicle interior, such as the .pn2automobile dashboard. Attachment is where the magnets attach to the certificate holder.

In the Smith patent No. 3,698,111, a generally rectangular document holder has a pair of flexible film-like transparent sheets fixed along opposite sides to a pair of elongated magnetic strips so that a document can be held in the transparent sheets and can hold an automobile registration or the like to a suitable position in the automobile. In the U.S. Pat. No. to Tannenbaum, 4,837,953, a device for displaying photographs is provided which includes a sheet holding assembly having first and second plastic members held together to secure a photograph or the like therebetween and includes a magnet for attaching the display to a metal surface, such as a refrigerator door. The Price patent No. 4,912,864, provides for a magnetized picture frame for displaying informational sheet material on a steel refrigerator and includes permanent magnets formed into the frame to magnetically adhere the frame to the refrigerator surface. The U.S. Pat. No. to Stern, 4,310,978 shows advertising and promotional display materials utilizing a body of elastometric material having a plurality of magnetic particles embedded therein. The Bevan patent No. 3,826,026, shows a display device which can be attached to an automobile or other vehicle and has a mounting sheet with a transparent sheet heat sealed to it so that material to be displayed can be slid between the sheets which can be attached to the outside of the vehicle. The Jahn patent No. 3,444,638, shows a display for a plurality of pictures which has window cutouts and a mount board and includes magnetic ribbons or strips and a transparent overlay which allows the mounted display material to be held in the frame by magnetic strips so that they can be removed from or inserted beneath the transparent cover as desired.

The present invention teaches a photo display apparatus having a frame with a planar mat therein and having a transparent polymer cover fixedly attached to one side and removably adhered to the other side with an adhesive which is also used to mount the photos to be displayed over the windows in the mat. The mat having transparent polymer covering over both sides is easily slid into the frame which may be supported on a ferric material or, alternatively, using support members can be supported on a horizontal surface.

SUMMARY OF THE INVENTION

A photo display apparatus has a frame having four side members and having an opening slot through one side member for the sliding of matted photographs or display items therethrough. A photo mat board has two sides and a plurality of windows cut out therein for mounting photographs or display items and a transparent polymer covering is fixedly attached to one side of the mat and is removably adhered to the other side of the mat. The mat is covered on one side with an adhesive material, such as a micro-encapsulated adhesive material for supporting display items over the cut out windows in the mat board for display and the polymer covering is removably adhered thereover and held to the mat with the same adhesive holding the display items. One or more display support members can be removably attached to the display frame for holding the display apparatus on a horizontal surface or alternatively attached to a flat ferric metal surface in a second position using magnetic strips attached to the display support member. Each display support member has a long arm and a short arm attached together at an angle to each other with the long arm having a magnetic strip thereon along with a spring clip for attaching a piece of mat board thereto.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
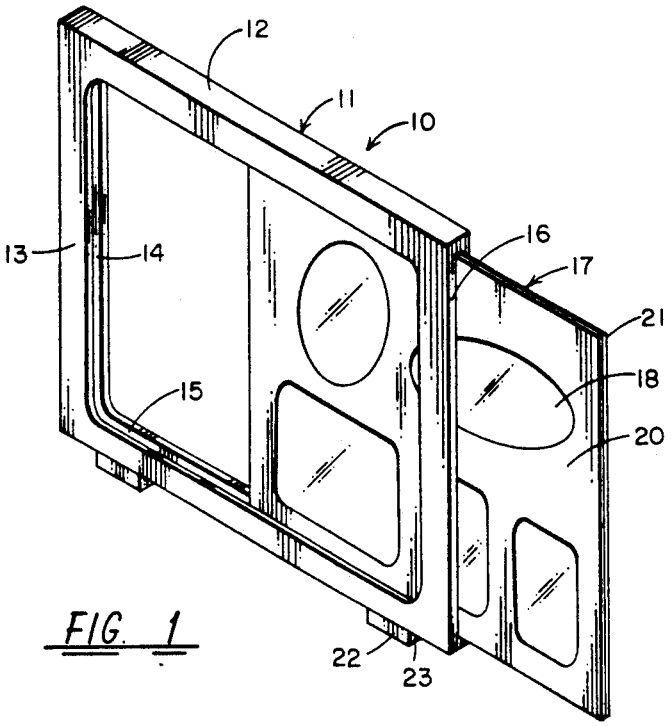
FIG. 1 is a front perspective view of a photo display apparatus in accordance with the present invention having the matted display items being inserted into the frame.
Figure 3:
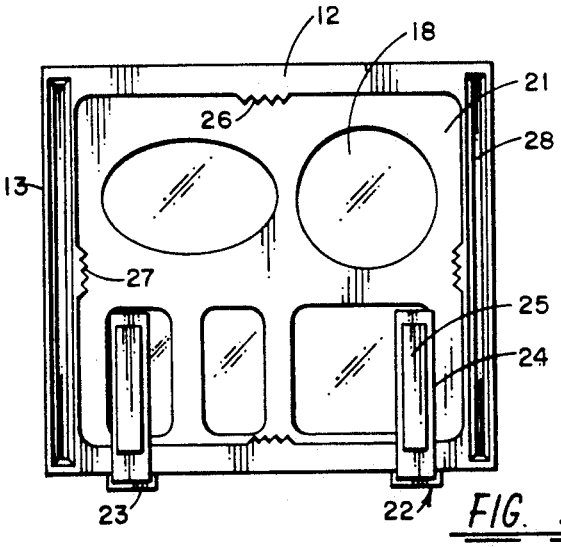
FIG. 3 is a rear elevation of the photo display of FIG. 1.
Figure 2:
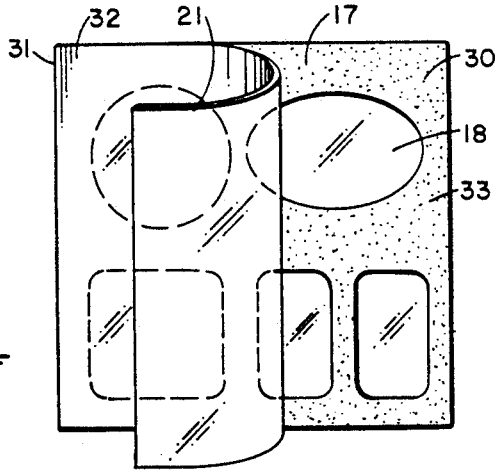
FIG. 2 is a front perspective view of the mat for the photo display of FIG. 1.

Referring to the drawings, FIGS. 1–3 a photo display apparatus 10 has a frame 11 having two parallel frame members 12 having grooves 15 therein and two parallel frame members 13 each having a groove 14 therein. One of the parallel frame sides 13 has a elongated slot 16 therein through which a mat board 17 having a plurality of window cutouts 18 therein and having a transparent polymer covering 20 over one side and fixedly attached thereto and a transparent polymer covering 21 removably adhered to the other side of the mat board 17. A pair of display supporting members 22 are attached to the frame 11 and have short arms 23 extending perpendicular to long arms 24 to form a generally L-shaped display support member. The long arm 24 of each display support member has an elongated strip of magnetic material 25 which may be a polymer impregnated with magnetic material and adhesively attached to the member 22 arm 24 for rapidly attaching to a surface. One of the frame member side members 12 can be seen in FIG. 3 to have a plurality of serrations 26 thereon for hanging the display 10 on a nail or picture hanging bracket attached to a wall. One of the frame members 13 can also be seen as having a plurality of serrated edges 27 for attaching with a nail or picture holding bracket to a wall. In addition to the supporting members 22, the frame members 13 may also have elongated polymer magnetic strips 28 attached thereto with an adhesive or the like for supporting the frame directly to a surface.

Figure 5:
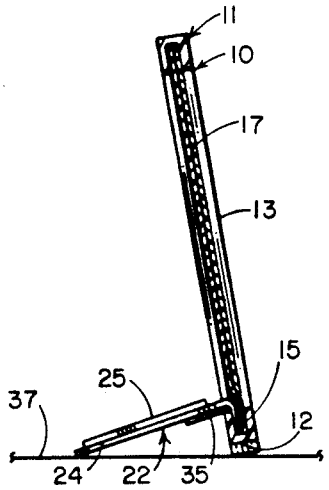
FIG. 5 is a side sectional view of the display of FIGS. 1–3 on a horizontal mount.
Figure 6:
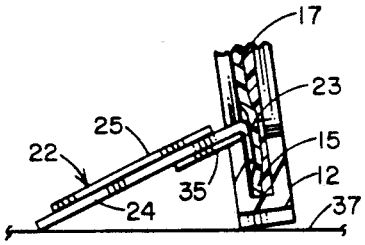
FIG. 6 is a partial sectional view on an enlarged scale of the display support member of FIG. 5.

As seen in FIG. 2, one side of the mat board 17 has a micro-encapsulated adhesive 30 coated thereonto so that photographs may be placed behind the window cutouts 18 to extend over the edges of the window 18 for positioning and attaching to the adhesive 30 on the mat board 17. This allows the photograph to be changed as well as repositioned as desired. The polymer covering 21 may then be placed over the back of the mat board 17 over the photographs attached over the windows 18 and adhered thereto with the micro-encapsulated adhesive 30 which adhesive is such that the polymer covering 21 can be easily raised and removed. The polymer sheet 21 may be transparent or not as desired while the polymer covering 20 over the front of the mat board 17 is transparent and is fixedly attached to the front with an adhesive. The polymer coverings 20 and 21 can be of one continuous sheet attached to the front of the mat board 17 and wrapped around one edge 31 of the mat board 30 then adhesively attached with a fixed adhesive along a strip 32 and removably adhered with adhesive 30 to the mount board 17 rear side 33. This allows photographs or display items to be rapidly changed by simply positioning on the mat board 17 over the windows 18 where they are adhesively held by using a small pressure along the edges of the photograph. The polymer cover 21 then is folded over the photographs and held by the same adhesive and the entire mat board 17 which is covered on both sides with the polymer covering can be slid through the open slot 17 in the frame 11 to display the items. The display can be quickly attached to a refrigerator with the magnetic strips or can alternatively be supported on a horizontal surface, as shown in FIGS. 5 and 6.

Figure 4:
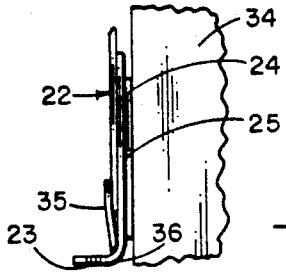
FIG. 4 is a partial side elevation of a display support member for the display of FIGS. 1–3.

The display supporting members 22 can be seen in FIG. 4 having a long arm 24 having a magnetic strip 25 attached thereto and attached to a metallic surface 34 and having a short arm 23 with a spring clip 35 attached to the long arm 24 at the junction 36 with the short arm 11. A display mat 17, as shown in FIG. 2, has a transparent polymer cover on both sides thereof and photographs attached thereto and the mat can then be slid into the spring clips 35 so that a pair of clips, as shown in FIG. 4, can be utilized to hold the matted photographs to a refrigerator or other metallic surface without having to utilize the frame 11. However, the display mat 17 is designed to be displayed in the frame and the spring clips 35 purpose is to hold a multiplicity of planar items, photos, coupons, messages, report cards etc. when clips are detached from rear of frame and attached to a metal surface by means of its magnetic strip.

Alternatively, the display support members 22 can use the short leg 23 to support the bottom of the frame 11, as shown in FIG. 3, so that the magnetic surfaces 25 can be used to attach the framed mounted photographs to a refrigerator or the like. In an alternative embodiment, the display support members 22 can support the framed photo display 10 with the frame 11 and the mounted photographs in the mount 17 by inserting the short arm 23 of the display support member 22 into the frame groove 15 so that the long arm 24 extends behind the frame where it rests on a flat horizontal surface 37, such as a desk or dresser top. The short arm 23 can be seen more clearly in FIG. 6 as being wedged in the groove 15 behind the mat board 17 and the pair of transparent covers 20 and 21 with the frame member 12 supported on the horizontal surface 37.

It should be clear at this time that a photo display apparatus has been provided which can easily have photographs attached and positioned in window mounts and matting board covered and supported in a frame which can be quickly attached to the side of a refrigerator or other ferric metal surface which can have supporting display support members which can be attached to the frame for supporting the frame in a generally upright position on a desk or dresser. However, it should be clear that the present invention is not to be construed as limited to the forms shown which are to be considered illustrative rather than restrictive.

I claim:

1. A photo display apparatus comprising:

a frame having four side members and having an opening slot through one side member;

a planar mat having two sides and a plurality of window cutouts therein;

a transparent polymer covering for said mat fixedly attached to the one side thereof and removably adhered to the other side thereof;

display holding adhesive for attaching an item to be displayed in said window cutout in said mat, said display holding adhesive covering one side of said mat to thereby support said displayed item along the edges of said window cutout to thereby hold said display item for display in said window cutout; and a display support member removable attachable to said frame for holding said display apparatus in a display position, said display support member also having a short arm and a long arm, said long arm having a magnetic strip attached thereto for attaching said display support member and display apparatus to a metal surface, and said long arm of said display support member also having a spring clip attached thereto for attaching planar materials thereto whereby said display support member magnetic strip can support planar materials to a metal surface.

2. A photo display apparatus in accordance with claim 1 in which said display support member is a generally L-shaped member having said short arm shaped to be inserted in one said frame member and thereby extend said long arm for supporting said frame.

3. A photo display apparatus in accordance with claim 2 in which said display has at least one frame member having a plurality of serrations thereon for hanging said frame to a wall supporting fastener.

4. A photo display apparatus in accordance with claim 3 in which said display has two frame members, each having a plurality of serrations thereon for hanging said frame to a wall supporting fastener.

5. A photo display apparatus in accordance with claim 4 in which said spring clip of said long arm is located at one end of said long arm adjacent said short arm.

6. A photo display apparatus in accordance with claim 5 in which said display holding adhesive is a micro-encapsulated adhesive material coating one side of said mat.

* * * * *